US008777095B2

(12) United States Patent
Cheema

(10) Patent No.: US 8,777,095 B2
(45) Date of Patent: Jul. 15, 2014

(54) PACKAGE FOR FOLDABLY PACKAGING A FOOD PRODUCT

(75) Inventor: Parbinder Cheema, Middlesex (GB)

(73) Assignee: Cadbury Holdings Limited, Uxbridge (GB)

( * ) Notice: Subject to any disclaimer, the term of this patent is extended or adjusted under 35 U.S.C. 154(b) by 140 days.

(21) Appl. No.: 12/997,975

(22) PCT Filed: Jun. 16, 2009

(86) PCT No.: PCT/GB2009/001483

§ 371 (c)(1),
(2), (4) Date: Feb. 24, 2011

(87) PCT Pub. No.: WO2009/153549

PCT Pub. Date: Dec. 23, 2009

(65) Prior Publication Data

US 2011/0139663 A1 Jun. 16, 2011

(30) Foreign Application Priority Data

Jun. 17, 2008 (GB) ..... 0811034.8

(51) Int. Cl.
*B65D 5/00* (2006.01)

(52) U.S. Cl.
USPC ..... 229/116; 229/112

(58) Field of Classification Search
USPC ..... 229/116, 112, 115, 111, 113; 383/907; 426/107, 234
See application file for complete search history.

(56) References Cited

U.S. PATENT DOCUMENTS

| | | | | | |
|---|---|---|---|---|---|
| 628,465 | A | * | 7/1899 | Horning | 229/116 |
| 658,849 | A | * | 10/1900 | Jack et al. | 229/116 |
| 2,882,990 | A | * | 4/1959 | Mustoe | 181/284 |
| 3,743,165 | A | * | 7/1973 | Hopkins | 206/515 |
| 3,924,013 | A | * | 12/1975 | Kane | 426/523 |
| 4,133,137 | A | * | 1/1979 | van Adelsberg | 43/114 |
| 4,568,018 | A | * | 2/1986 | Husnik | 229/249 |
| 4,881,685 | A | * | 11/1989 | Isao | 229/115 |
| 4,941,427 | A | * | 7/1990 | Houssian | 118/326 |
| 5,046,660 | A | * | 9/1991 | Magnoni | 229/4.5 |
| 5,842,630 | A | * | 12/1998 | Remer | 229/116 |

FOREIGN PATENT DOCUMENTS

| | | | | | |
|---|---|---|---|---|---|
| DE | 195 32 454 | A1 | | 3/1997 | |
| EP | 254934 | A2 | * | 2/1988 | B65D 5/36 |
| EP | 279485 | A1 | * | 8/1988 | B65D 5/50 |
| FR | 2 841 215 | A | | 12/2003 | |
| FR | 2 854 871 | A | | 11/2004 | |
| NL | 6 413 839 | A | | 5/1965 | |

* cited by examiner

*Primary Examiner* — David Fidei
(74) *Attorney, Agent, or Firm* — Hoffman & Baron, LLP

(57) ABSTRACT

A package (10) for packaging a food product is made from a sheet (12) of foldable material. The sheet (12) defines a base area on which a food product (14) may be positioned and three or more side wall regions (20) about the base area that are folded upwardly and inwardly to form a parcel for surrounding and containing a product positioned on the base area. The side wall regions (20) converge towards a point located substantially centrally above the base area and an external fin seal (24) is provided between each adjacent pair of side wall regions. The fin seals (24) may be formed by bonding at least part of the opposing inner surfaces of the material forming each fin seal together using a peelable adhesive.

15 Claims, 7 Drawing Sheets

PACKAGE FOR FOLDABLY PACKAGING A FOOD PRODUCT

CROSS-REFERENCE TO RELATED APPLICATIONS

This application is the National Stage of International Application No. PCT/GB2009/001483, which designates the U.S., filed Jun. 16, 2009, which claims the benefit of GB 0811034.8, filed Jun. 17, 2008, the contents of which are incorporated by reference herein.

TECHNICAL FIELD OF THE INVENTION

The present invention relates to package and in particular to an improved package for food products such as confectionery. The present invention is also directed to a blank and method of making such package.

BACKGROUND TO THE INVENTION

Packaging for food products, such as confectionery, often serves a number of functions. These may included protecting the product and providing information about the product to the end user. In some cases, the primary function of the packaging is to be attractive to the customer. This may be particularly so where the product is a confectionery or other food product which may be given as a treat or gift and where the visual appearance of the packaging and novel methods of opening may play an important part in the overall experience for the end user.

It is known to package food products in a sheet wrapper that is folded about the product and sealed to keep the product fresh. This type of packaging is often used to package generally block-shaped food products, such as chocolate bars and other snack type confectionery products. The wrapper is fabricated from a sheet of foldable material that is substantially gas and moisture impervious, in order to maintain the freshness of the product. The sheet is wrapped around the product and is sufficiently long that it extends beyond the front and rear surfaces of the product. Opposing inner surfaces of the sheet are brought into contact to form seals along the front and rear edges of the package and the inner surfaces of side portions of the sheet are also brought into contact to form a fin seal along the length of the package.

The shape and construction of this known type of packaging is largely functional with the intention of providing a sealed package to protect the contents. Any visual attractiveness is generally provided by the design printed on the outside of the wrapper.

There is a need, therefore, to provide an alternative form of packaging which having a novel construction which can add to the overall attractiveness of the product.

There is also a need to provide an alternative form of packaging whose construction enables the package to be opened easily to reveal the product inside.

SUMMARY OF THE INVENTION

In accordance with a first aspect of the invention, there is provided a package for packaging a food product, the package comprising a sheet of foldable material, the sheet having a base area on which a food product may be positioned and three or more side wall regions about the base area that are folded upwardly and inwardly to form a parcel for surrounding and containing a product positioned on the base area, in which the side wall regions converge towards a point located substantially centrally above the base area and an external fin seal is provided between each adjacent pair of side wall regions.

The package may have an even number of side wall regions and fin seals and the fin seals may be arranged in opposed pairs.

The base region may be shaped generally as a regular polygon and there may be a side wall region connected with each side of the polygon by means of a fold line.

The side wall regions may be generally triangular in shape and configured to form a generally pyramid shaped parcel, the fin seals being located at the corners.

In one embodiment, there are four side wall regions and four fin seals.

The fin seals may project outwardly from a main body of the package.

Part or all of the opposing surfaces of the material forming each fin seal may be bonded together.

The package may be formed from a blank of foldable material. Adhesive may be applied to an inner surface of the blank, at least on regions of the blank which form the fin seals.

In accordance with a second aspect of the invention, there is provided a blank for forming a package, the blank comprising a sheet of foldable material defining a central base region, side wall regions located about the base region and connected with the base region by means of fold lines and tabs connected by means of fold lines with side edges of the side wall regions.

The base region may be generally shaped as a regular polygon, with a generally triangular side wall region connected via a fold line along each side of the polygon.

A respective tab may be provided along each side edge of each side wall region, with each tab being connected with its respective side wall region by means of a fold line.

The tabs positioned between each adjacent pair of side wall regions may be interconnected at their inner ends by means of a further fold line.

Adhesive may be is applied to the inner surface of the sheet at least within part of each tab.

In accordance with a third aspect of the invention, these is provided a method of forming a package in accordance with the first aspect of the invention using a blank in accordance with the second aspect of the invention, the method comprising, placing a product on the inner surface of the sheet within the base region, folding each of the side wall regions upwardly and inwardly such that they converge towards a point located centrally above the base region to surround and contain the product, forming the fin seals by brining the inner surfaces of each pair of tabs positioned between each adjacent pair of side wall regions into contact and bonding them together.

BRIEF DESCRIPTION OF THE DRAWINGS

Several embodiments of the invention will now be described, by way of example only, with reference to the accompanying drawings, in which.

The same reference numerals but increased by 100 in each case will be used to identify the same or similar features in each of the embodiments described below.

DETAILED DESCRIPTION OF PREFERRED EMBODIMENTS

Figure 1:
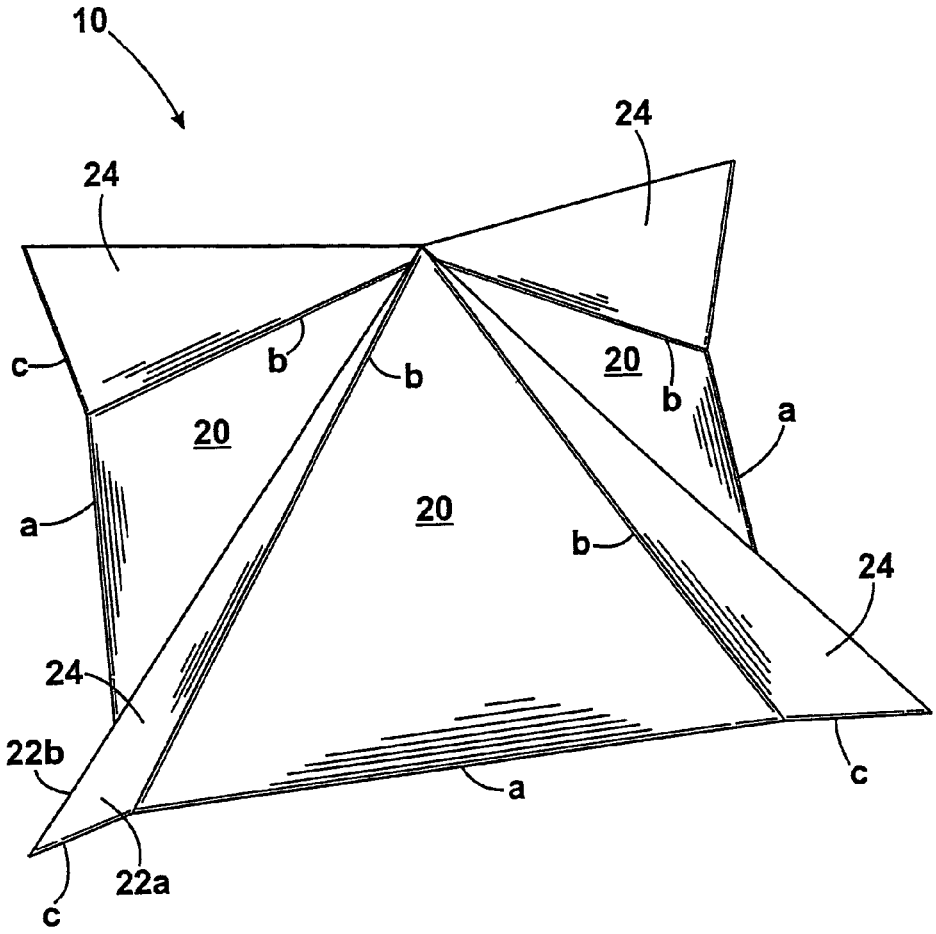
FIG. 1 is a perspective view of a package in accordance with a first embodiment of the invention.
Figure 2:
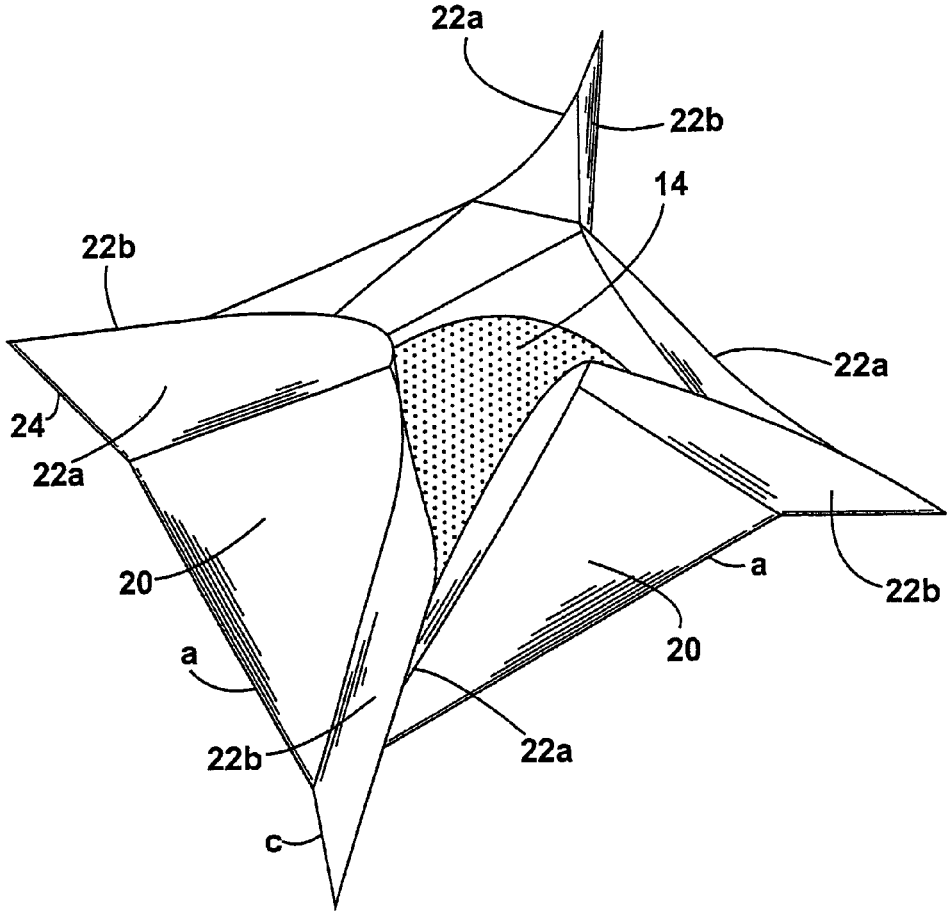
FIG. 2 is a perspective view showing the package of FIG. 1 partially formed about a product.
Figure 3:
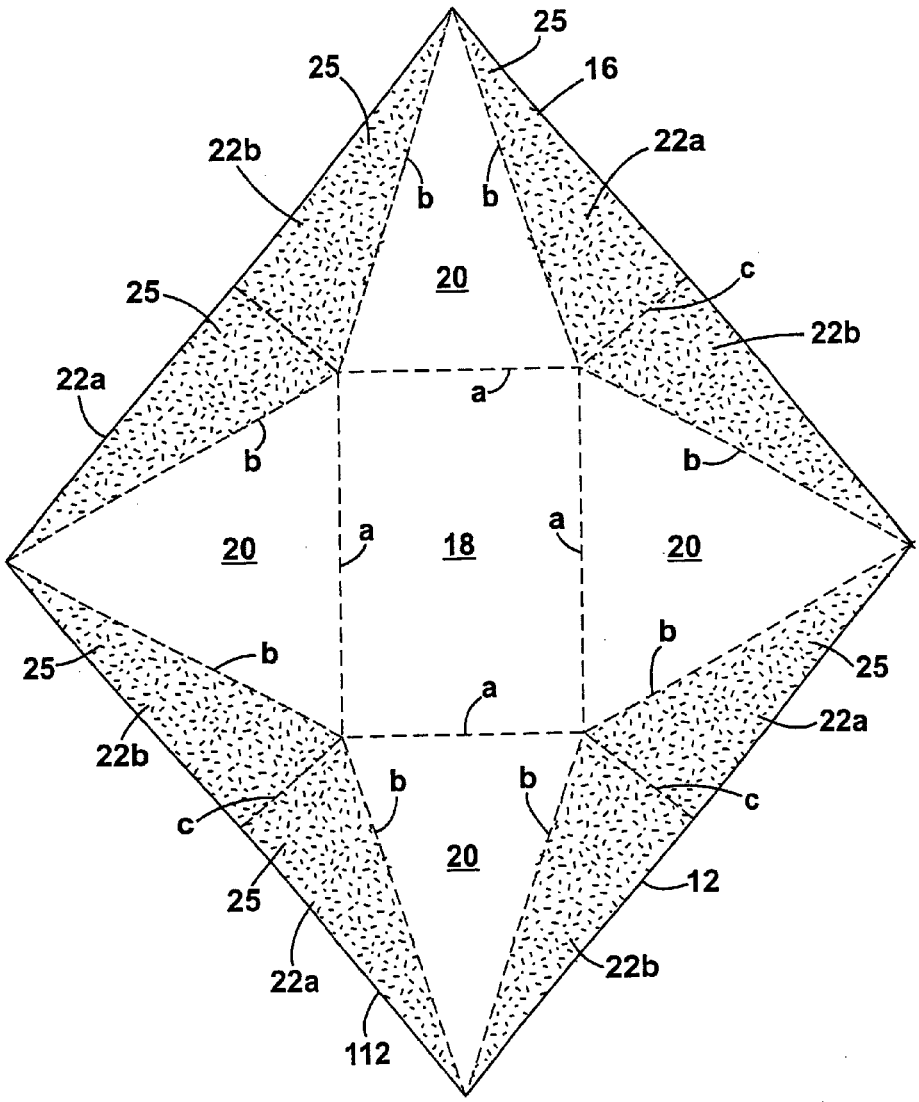
FIG. 3 is a plan view of a blank of foldable material for forming the package of FIG. 1.

With reference initially to FIGS. 1 to 3, a package 10 in accordance with a first embodiment of the invention comprises a sheet or blank 12 of foldable material which is folded about a food product 14 to form a generally pyramid shaped parcel enclosing the product.

The sheet 12 can be made of any suitable foldable material. For example, the sheet may be made of a paper based material, one or more polymers, or a metallic foil. The sheet may also be a laminated sheet comprising layers of different materials, such as those mentioned above, in any suitable combination.

With reference to FIG. 3, the sheet 12 in this embodiment is generally square in shape and has an inner surface 16 in which is defined a central base region 18 on to which the product 14 is placed. In the present embodiment, the base region 18 is rectangular but the base region could have different shapes. For example, the base may be any suitable regular polygonal shape, such as a triangle, square, rectangle or hexagon for example. In one embodiment, the base region 18 has an even number of sides, for reasons that will be discussed in more detail later.

A triangular side wall region 20 is connected with each side of the base region 18 by means of a fold line fold line a. The side wall regions 20 can be folded upwardly and inwardly about the fold lines to form a generally pyramid shaped parcel for containing a product positioned on the base region.

Extending along either side edge of each side wall region 20 is a tab 22*a*, 22*b* for forming external fin seals 24 between each adjacent pair of side wall regions 20 to close the package 10. Each tab 22*a*, 22*b*, is connected with a respective edge of the side wall region by a fold line b. The tabs 22*a*, 22*b* are provided in pairs between each adjacent pair of side wall regions 20 with the inner ends of each pair of tabs 22*a*, 22*b* being connected by a further fold line c.

An adhesive 25 is applied to the inner surface 16 of the sheet 12 at least within all or part of the tabs 22*a*, 22*b*. When the sheet 12 is folded to form the package, the inner surfaces of the pair of tabs 22*a*, 22*b* between each adjacent pair of side wall regions are brought into contact and bonded together to form the fin seals 24.

The adhesive may be a pressure sensitive coating which forms a seal upon the application of moderate pressure without the need to apply additional heat. The adhesive may be peelable and may be a sealable and re-sealable wax-like composition that could be based on a natural and/or synthetic rubber or a styrene based polymer, for example. Such a composition can be peeled apart to open the packaging but will re-seal if the surfaces are brought back into contact to re-close the package. The seal formed when the package is re-closed need not be as strong as the initial seal but will be sufficient to prevent the opposing surfaces from falling apart without the application of at least a minimal force to separate them. The sealing composition could, for example, be a self-adhesive thermoplastic material. Alternatively, the sealing composition may be a temperature sensitive adhesive.

The method of constructing the package 10 will now be described with reference to FIGS. 1 to 3.

With the sheet 12 as shown in FIG. 3, a product 14 is positioned on the on the inner surface of the sheet within the base region 18. The side wall regions 20 are then folded upwardly and inwardly about the fold line a, which is formed into a ridge fold when considered from the outside of the container. The fold lines c between adjacent tabs 22*a*, 22*b* are also formed into ridge folds whilst the fold lines b are formed into valley folds, both when considered from the outside of the package as shown in FIGS. 1 and 2.

The triangular side wall regions 20 are folded to bring the apex of the triangles together at a point located centrally above the base region 18 and the product 14 to form a container or parcel for the product which is generally shaped like a pyramid. The inner surfaces of the tabs 22*a*, 22*b* between each pair of adjacent side wall regions 20 are brought into contact and bonded together by means of the adhesive to form externally projecting fins along the corners of the pyramid as shown in FIG. 1.

In the present embodiment, the base is rectangular so that there are four side wall regions 20 and a corresponding number of fins 24. The fins 24 can be considered as forming diagonally opposed pairs of fins 24*a*, 24*b*. In order to open the package, a user can grasp one pair of diagonally opposed fin seals 24*a*, 24*b* and pull them outwardly which will result in the other pair of fin seals 24*a*, 24*b* being peeled apart. This arrangement not only provides a convenient method of open the package but it is also very enjoyable for the user as the contents of the package are revealed when the package is opened.

It can be seen that packaging in accordance with the invention provides a parcel like package which is visually attractive and which has a convenient and yet novel method of opening. The packaging is particularly suitable for use in packaging confectionery products which may be presented to someone as a gift or treat and in which the packaging and opening of the packaging play in integral part in the user's enjoyment of the product.

The sheet 12 may be printed on, particularly on its outer surface, to provide a decorative finish and/or to provide information about the product.

The package 10 may be constructed to form a fully sealed container for the product and the sheet may be made of a material which is substantially impervious to moisture and gas. However, this is not essential and the package may not be fully sealed. In this case, the product 14 to be placed within the package 10 may itself be wrapped or placed in an inner container. There may be more than one product 14 in each package 10.

It will be appreciated that a package in accordance with the invention can be made in a variety of shapes and sizes. For example, the base region 18 may be triangular and the package may have only three side wall regions 20 and three fin seals. In this case, it will not be possible to open the package 10 by pulling two of the fin seals apart but it will be necessary to peel the tabs forming at least one of the fin seals 24 apart to open the package.

Figure 4:
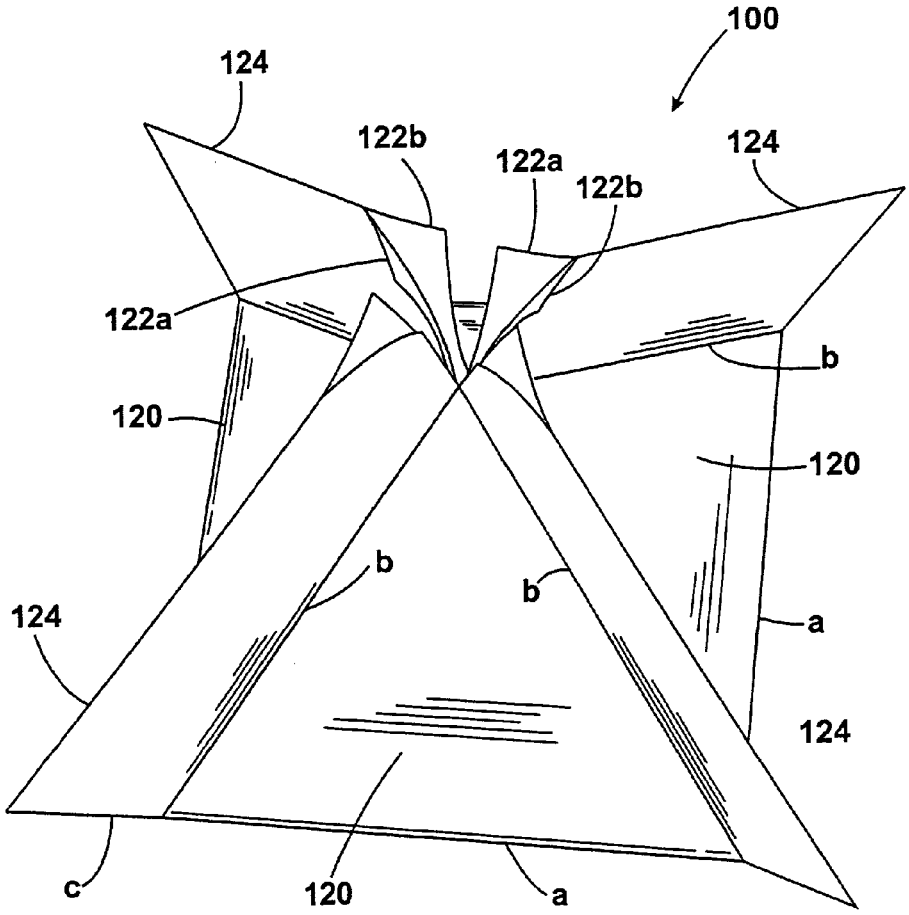
FIG. 4 is a perspective view of a package in accordance with a second embodiment of the invention.
Figure 5:
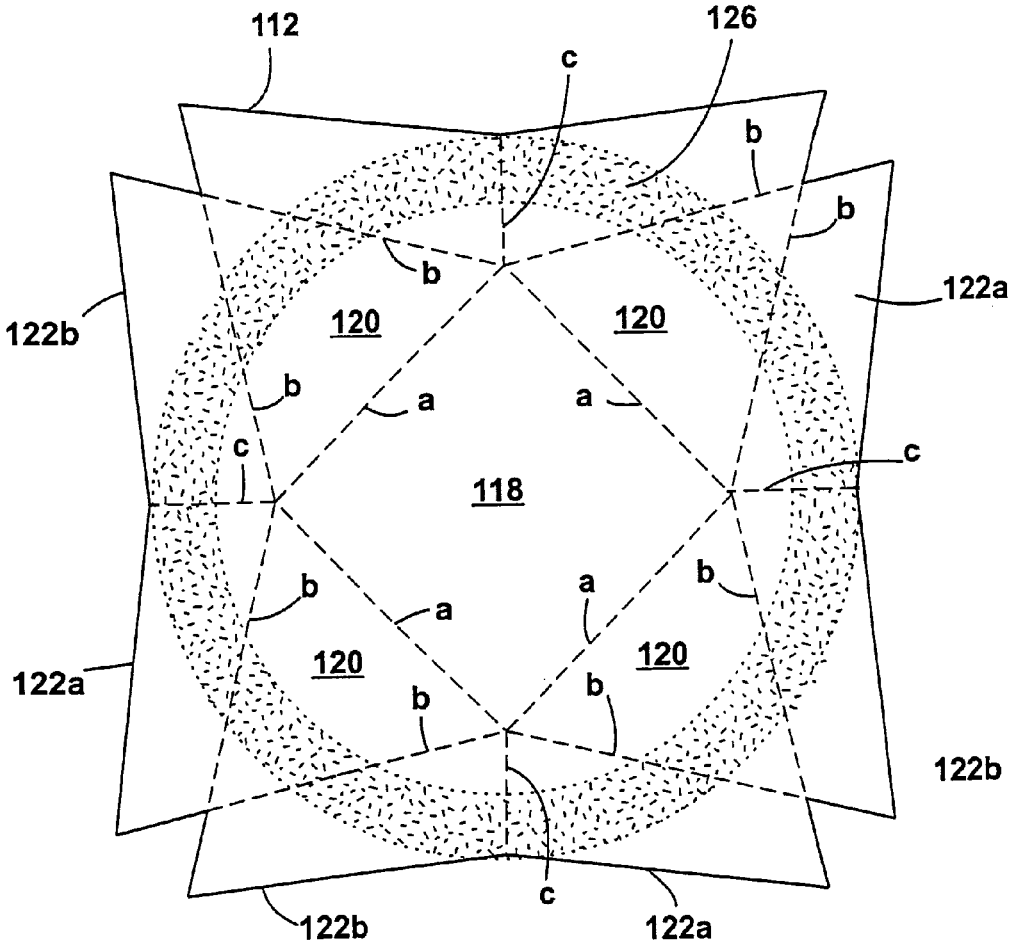
FIG. 5 is a plan view of a blank of foldable material for forming the package of FIG. 4.

FIGS. 4 and 5 illustrate a further embodiment of a package 110 in accordance with the invention.

In this embodiment the sheet 112 has a square base region 118 and the side wall regions 120 are shaped substantial as equilateral triangles. The tabs 122*a*, 122*b* which form the fin seals 124 are substantially rectangular so as to project beyond the apex of the side wall regions 120.

When folded into the completed package 110, the upper ends of the fin seals 124 extend above the apex of the main body of the package, as defined by the base region and the side wall regions, and are spaced slightly apart from one another. As shown in FIG. 4, the outer edges of the upper end region of the tabs 122*a*, 122*b* may not be bonded to one another so that the tabs can be peeled apart to open the package. However, the package can be opened by pulling apart one pair of diagonally opposed fins 124 as with the previous embodiment, in which case the tabs 122*a*, 122*b* may be fully bonded.

The adhesive may be applied only to the inner surfaces of the tabs 122*a*, 122*b* or, as illustrated in FIG. 5, the adhesive may also be applied to at least an upper portion of the inner surface of the side wall regions 120. As shown in FIG. 5, the adhesive could be applied in a circle 126 which passes through part of each tab 122*a*, 122*b* and an upper part of the side wall regions 220. When the package is formed, those parts of the tabs 122*a*, 122*b* to which the adhesive is applied will be bonded together. Upper parts of the opposing side wall regions 120 may also be bought into contact above the products and bonded together by the adhesive. This alternative adhesive arrangement may be adopted in any of the embodiments disclosed herein.

It will be appreciated that the adhesive can be applied to the inner surface of the sheet 12, 112 in numerous different ways in order to vary the final appearance of a package in accordance with the invention.

Figure 6:
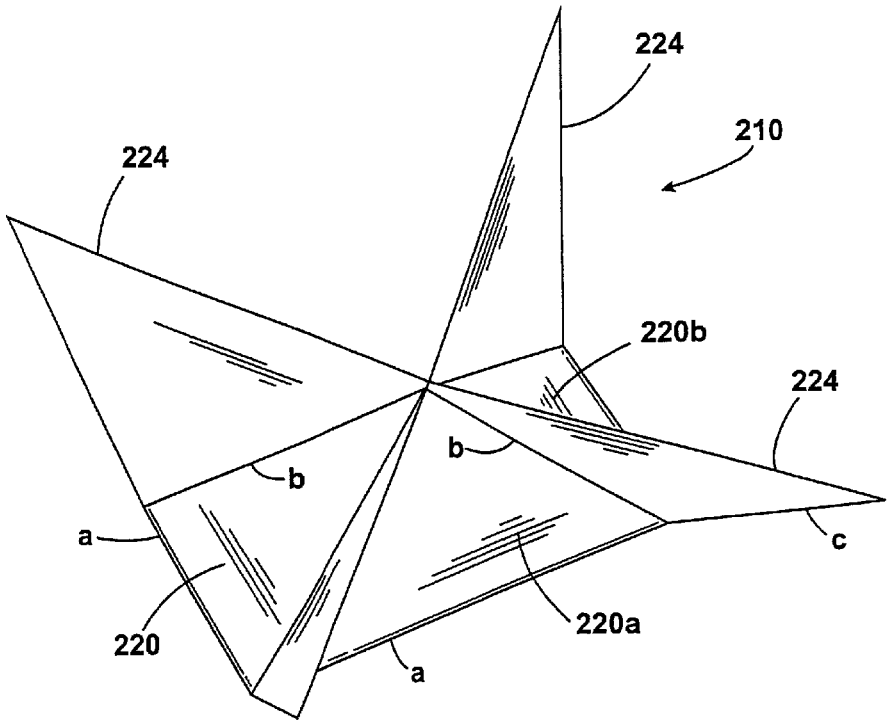
FIG. 6 is a perspective view of a package in accordance with a third embodiment of the invention; and, FIG. 7 is a plan view of a blank of foldable material for forming the package of FIG. 6.
Figure 7:
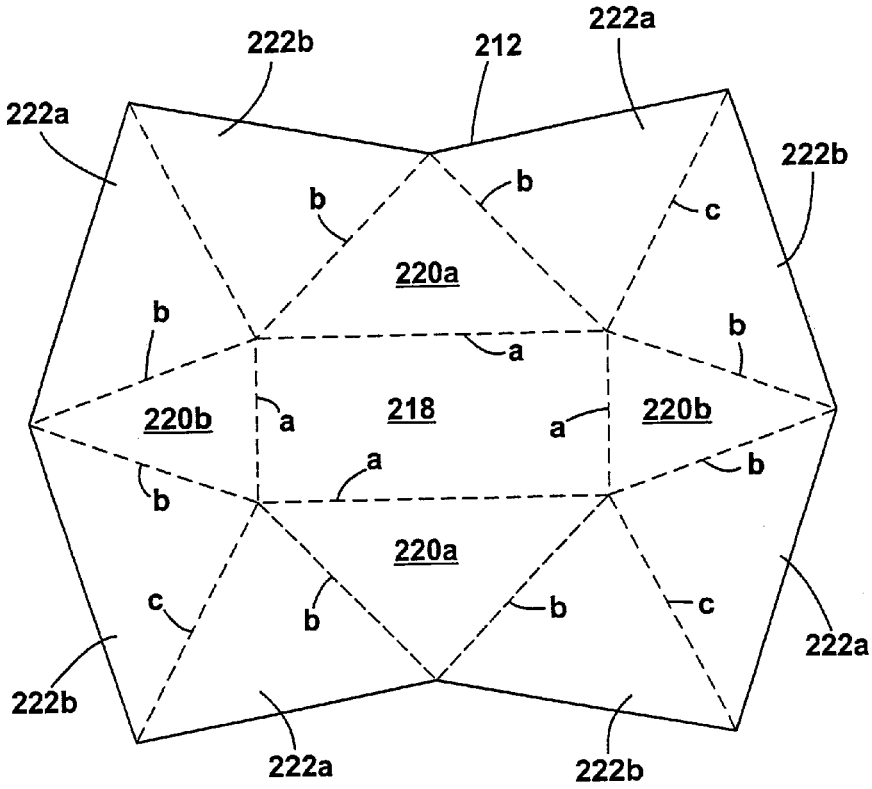

FIGS. 6 and 7 illustrate a further embodiment of a package 210 in accordance with the invention.

In this embodiment, the fin seals 224 are much larger than in the previous embodiment and are designed to project upwardly and outwardly from the main body in the completed package as shown in FIG. 6. The base region 218 is rectangular and the side wall regions 220 are shaped as isosceles triangles. The side wall regions 220*a* which connect with the longer side edges of the rectangular base 218 have a longer lower edge at fold line a, with shorter side edges at fold lines b. In contrast, the side wall regions 222*b* which connect to the shorter edges of the rectangular base have a shorter lower edge at fold line a and longer side edges at fold lines b. The tabs 222*a*, 222*b* which form the fins 224 are proportionally larger than in previous embodiments and their inner ends which join at fold lines c are greater in depth than the height of the side wall regions 220.

It will be appreciated that packaging having numerous other shapes can be constructed in accordance with the teaching in this document and in accordance with the principles of the present invention. Whilst, all the embodiments shown have four side wall regions and four fin seals, packages may be constructed with three, five, six, seven or more side wall regions and a corresponding number of fin seals. Furthermore, whilst in the embodiments shown the base region and the side wall regions have a clearly defined polygonal shape, depending on the nature of the material used and the size and shape of the product, the base and side wall regions may be less well defined so as to only approximate to the shapes as shown. For example, where the material used is very flexible, the base region may in fact have an almost circular shape in the completed package with the side wall regions only approximating to a pyramid shape. What is important is that the side wall regions converge towards a point located generally centrally above the base and that the package has externally projecting fin seals between each of the side wall regions.

It is of course to be understood that the invention is not intended to be restricted to the details of the above embodiments, which are described by way of example only.

The invention claimed is:

1. A package for packaging a food product, the package comprising a sheet of foldable material having opposing surfaces, the sheet having a base area on which a food product is positioned and three or more generally triangular side wall regions about the base area each of said triangular side wall regions having a base connected to the base area at a fold line and side edges, which converge to an apex opposite the base, said side wall regions are folded upwardly and inwardly to form a parcel for surrounding and containing a product positioned on the base area, in which the side wall regions apices opposite the base converge at a point located substantially centrally above the base area and an external peelable fin seal is provided along the side edges between each adjacent pair of side wall regions, and at least part of the opposing surfaces of the material forming each fin seal are bonded together wherein said fin seal is capable of being peeled apart.

2. A package as claimed in claim 1, in which there are an even number of side wall regions and fin seals.

3. A package as claimed in claim 2, in which the fin seals are arranged in opposed pairs.

4. A package as claimed in claim 1, in which the base area is shaped generally as a regular polygon and a side wall region is connected with each side of the polygon by a fold line.

5. A package as claimed in claim 1, in which the side wall regions are generally triangular in shape and are configured to form a generally pyramid shaped parcel, the fin seals being located at the corners.

6. A package as claimed in claim 1, in which there are four side wall regions and four fin seals.

7. A package as claimed in claim 1, in which the fin seals project outwardly from a main body of the package.

8. A package as claimed in claim 1, in which the whole of the opposing surfaces of the material forming each fin seal are bonded together.

9. A package as claimed in claim 1, in which the package is formed from a blank of foldable material.

10. A package as claimed in claim 9, in which adhesive is applied to an inner surface of the blank on regions of the blank which form the fin seals.

11. A blank for forming a package as claimed in claim 9, the blank comprising a sheet of foldable material defining a central base region, side wall regions located about the base region and connected with the base region by means of fold lines and tabs connected by means of fold lines with side edges of the side wall regions.

12. A blank as claimed in claim 11, in which the base region is generally shaped as a regular polygon, with a generally triangular side wall region connected via a fold line along each side of the polygon.

13. A blank as claimed in claim 12, in which a respective tab is provided along each side edge of each side wall region, each tab being connected with its respective side wall region by means of a fold line.

14. A blank as claimed in claim 13, in which tabs positioned between each adjacent pair of side wall regions are interconnected at their inner ends by means of a further fold line.

15. A blank as claimed in claim 11, in which adhesive is applied to the inner surface of the sheet at least within part of each tab.

* * * * *